US005931433A

United States Patent [19]

Padmos

[11] Patent Number: 5,931,433

[45] Date of Patent: Aug. 3, 1999

[54] STA DRY HEADROOM ADAPTER

[76] Inventor: Leonard M. Padmos, 22417 Edmunton, Saint Clair Shores, Mich. 48080

[21] Appl. No.: 08/956,398

[22] Filed: Oct. 23, 1997

[51] Int. Cl.[6] ..... F16M 11/16; A47B 96/06

[52] U.S. Cl. ..... 248/345; 248/188; 248/219.2; 248/220.1

[58] Field of Search ..... 248/370, 188, 248/219.2, 220.1, 345, 302; 135/66, 68, 69, 114, 120.1, 161

[56] References Cited

U.S. PATENT DOCUMENTS

| | | | |
|---|---|---|---|
| 15,592 | 8/1856 | Henry | 135/161 |
| 1,625,673 | 4/1927 | Nelson | 135/161 |
| 1,669,611 | 5/1928 | Goldberg | 135/114 |
| 1,769,167 | 7/1930 | Scheihing | 135/68 |
| 1,846,305 | 2/1932 | Brooks | 135/114 |
| 3,304,035 | 2/1967 | Davis | 135/66 |
| 3,995,890 | 12/1976 | Fletcher | 296/10 |
| 3,999,565 | 12/1976 | Delacour et al. | 135/69 |
| 4,195,877 | 4/1980 | Duda | 133/90 |
| 4,637,415 | 1/1987 | Dalo et al. | 135/98 |
| 4,750,509 | 6/1988 | Kim | 133/90 |
| 5,002,083 | 3/1991 | Kim | 133/90 |
| 5,035,253 | 7/1991 | Bortles | 135/89 |
| 5,149,042 | 9/1992 | Dumais | 248/317 |
| 5,193,567 | 3/1993 | Razny, Jr. | 135/68 |
| 5,255,698 | 10/1993 | Riley | 135/103 |
| 5,579,797 | 12/1996 | Rogers | 135/90 |
| 5,632,292 | 5/1997 | Carter | 135/145 |

FOREIGN PATENT DOCUMENTS

| | | | |
|---|---|---|---|
| 4102498 | 7/1992 | Germany | 135/68 |
| 1710049-A1 | 2/1992 | U.S.S.R. | 135/68 |
| 14906 | 6/1910 | United Kingdom | 135/66 |

*Primary Examiner*—Leslie A. Braun
*Assistant Examiner*—Michael D. Nornberg
*Attorney, Agent, or Firm*—Patent & Trademark Services; Joseph H. McGlynn

[57] ABSTRACT

An accessory which can be attached to the supports for the tent and which will raise up the roof structure of the tent to prevent rainwater from pooling on the roof and leaking into the tent. The attachment has a member which attaches to one of the tent supports and a second member which raises the tent roof.

9 Claims, 1 Drawing Sheet

STA DRY HEADROOM ADAPTER

BACKGROUND OF THE INVENTION

This invention relates, in general, to attachments for camping tents, and, in particular, to an attachment to prevent rain water from pooling on top of the tent.

DESCRIPTION OF THE PRIOR ART

In the prior art various types of tents and tent attachments have been proposed. For example, U.S. Pat. No. 4,195,877 discloses a tent like addition that can be attached to the side of a mobile home. The attachment has front and side panels and a roof panel which are all watertight.

U.S. Pat. No. 4,750,509 discloses a folding tent with structural members which are secured to an overhead hub which makes assembling and disassembling the tent quick and easy.

U.S. Pat. No. 5,002,083 discloses a tent cover which attaches to a hook on the tent support structure by means of a rubber string to prevent the tent cover from slipping down the supports.

U.S. Pat. No. 5,579,797 discloses a foldable, adjustable height canopy support which is secured to an adjustable height mast.

SUMMARY OF THE INVENTION

The present invention is directed to an accessory which can be attached to the supports for the tent and which will raise up the roof structure of the tent to prevent rainwater from pooling on the roof and leaking into the tent. The attachment has a member which attaches to one of the tent supports and a second member which raises the tent roof.

It is an object of the present invention to provide an accessory for a tent which will prevent rain water from pooling on the roof of the tent.

It is an object of the present invention to provide an accessory for a tent which will be easily and quickly attached to any existing tent structure.

These and other objects and advantages of the present invention will be fully apparent from the following description, when taken in connection with the annexed drawings.

DESCRIPTION OF THE PREFERRED EMBODIMENT

Figure 1:
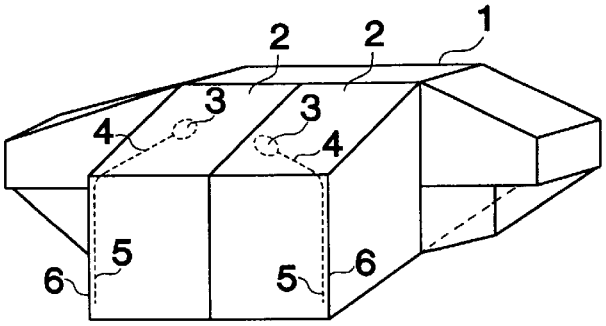
FIG. 1 is a view of the present invention attached to a tent.
Figure 5:
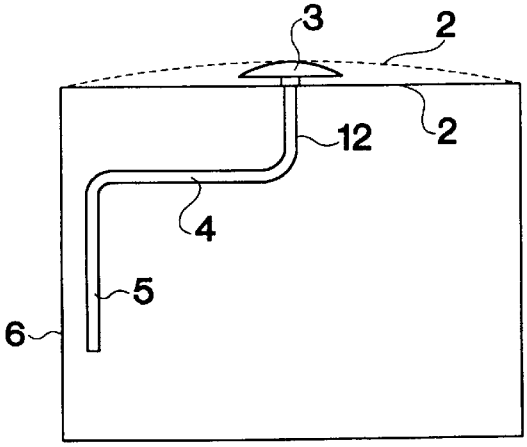
FIG. 5 is a side view of the side and roof segments of a tent with the present invention attached.

Referring now to the drawings in greater detail, FIG. 1 shows a pop-up camper 1 with vertical support poles 6 which hold up a roof section 2 of the camper. The present invention is shown attached in two locations to the vertical support poles 6 in order to raise the roof section 2 as shown in FIG. 5. It should be noted that the particular type of tent shown in the drawings are merely for illustration purposes, and the present invention could be used with any type of tent. Also, the present invention is shown as positioned in two places, however, the number of supports for the roof of the tent or camper can vary with the type of tent or camper being used.

Figure 2:
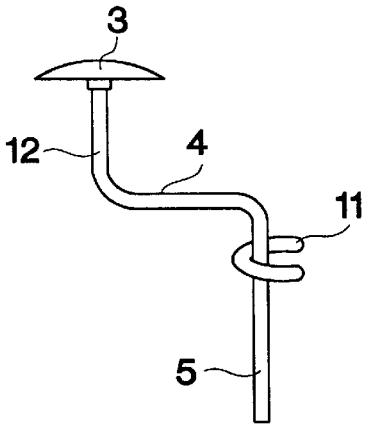
FIG. 2 is a side view of the present invention.

As shown in FIG. 2, the roof support for the tent roof comprises a vertical pole 5 which can be attached to one of the vertical tent supports 6. The preferred mode of attachment is a strap 11, shown also in FIG. 3, which has a ring or loop 7 attached at one end by any conventional means. The other end of the strap 11 has VELCRO hook and loop fasteners 8, 9 attached thereto. The strap 11 will be wrapped around the poles 5, 6, the end having the Velcro hook and loop fasteners 8, 9 will be passed through the ring 7, and then the fastener 8 will be secured to the fastener 9 in order to secure the pole 5 to the pole 6.

Attached to the vertical pole 5 is a horizontal pole 4 which in turn has a second vertical pole 12 attached thereto. The vertical and horizontal sections can be secure to each other in any conventional manner, including making the sections unitary with each other. Secured to the vertical pole section 12 is a domed shaped cap 3 which should be smooth and rounded on top in order to prevent it from damaging the roof of the tent section.

Figure 3:
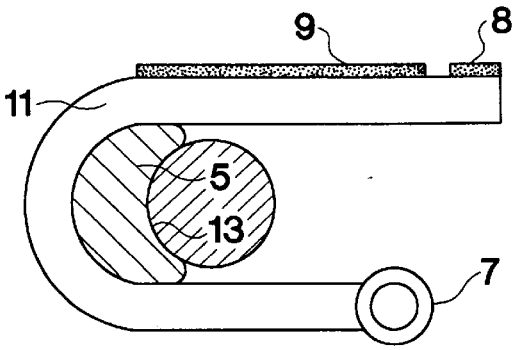
FIG. 3 is a cross-sectional view of one of the support poles of the present invention.

As shown in FIG. 3, the vertical pole section 5 has a concave cross-sectional shape 13 which will conform with the outside surface of the tent pole 6 to insure a snug fit when the strap or straps 11 are attached. In addition, the tent poles 6 and the poles 4, 5, 12 are shown as being tubular, however, they can be any shape as long as they can perform their intended function. Also, if the pole 6 is another shape (for example rectangular) The shape 13 should be made to match the shape of the pole 6.

Figure 4:
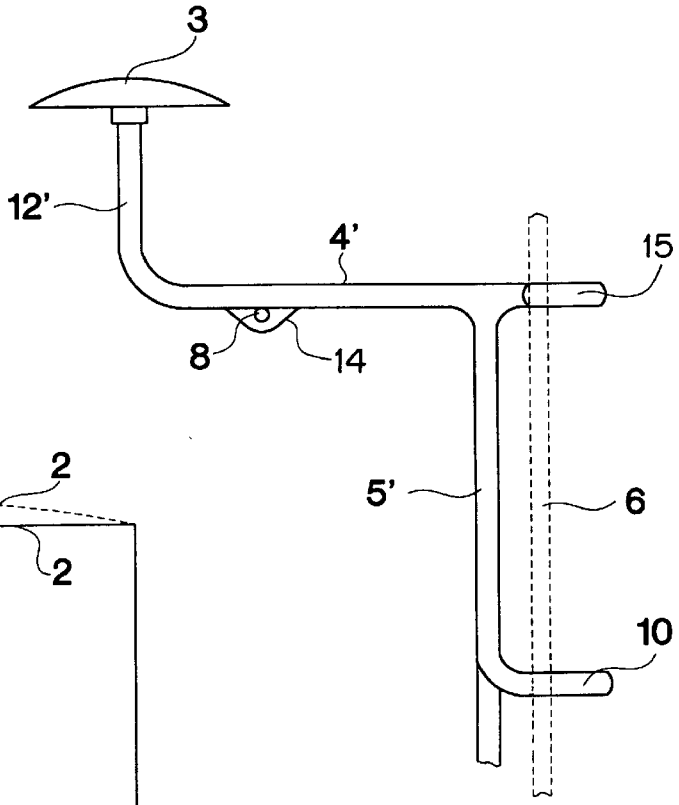
FIG. 4 is a side view of another embodiment of the present invention.

FIG. 4 shows a second embodiment of the present invention which does not need the strap or straps 11 to attach the present invention to the tent poles 6. The roof support shown in FIG. 4 has the same doomed top 3, a vertical pole section 12', and a vertical pole section 5' which perform essentially the same functions as the same parts in the FIG. 2 device. However, the horizontal pole 4' has a flange 14 with an aperture 8 therethrough, which can be used to support a lantern or other equipment.

In addition, the pole 5' has a hook 9 near the top of the pole section and a forked portion 10 adjacent the bottom of the pole section 5'. In order to attach the pole 5' to the tent pole 6, the user would slip the hook portion 15 around the tent pole 6 and then pivot the pole 5' down until the forked portion 10 engages the tent pole 6. As the tent roof pushes on the doomed top 3, as will be explained in greater detail below, the forked portion 10 will be pushed against one side of the pole 6, while the hooked portion 15 will be pulled against the opposite side of the pole 6. This push-pull force on the vertical section 5' will secure it to the tent pole 6.

FIG. 5 shows the present invention in operation. The vertical section 5 (or 5') has been secured to the tent pole 6 (it should be noted that the straps 11 have been removed for clarity). The pole 5 should be placed on the pole 6 at such a height that the doomed top 3 will raise the tent roof 2 from the position shown in solid lines to the position shown in dotted lines in FIG. 5. In this position, the tent roof will be slanted so that any rain water, or other condensation, will run off the roof before it can accumulate. If water or snow is allowed to accumulate on the roof, it will eventually begin to leak into the tent, or it will become so heavy it could tear the tent roof. By raising the tent roof to a slanted shape, water will not be allowed to accumulate on top of the roof, but will continuously run off as it strikes the slanted tent roof.

Although the Sta Dry Headroom Adapter and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for raising the roof of a tent in order to prevent water from accumulating on the roof, said tent having at least one vertical pole for supporting a tent roof, said apparatus comprising:

a vertical support member having means for attaching said vertical support member to said at least one vertical pole for supporting a tent roof, means attached to and extending from said vertical support member for raising the roof of said tent from a first position to a second position, said second position being above said first position, and said means for attaching said vertical support member to said at least one vertical pole for supporting a tent roof is a strap adapted to surround said vertical support member and said at least one vertical pole, and wherein said vertical support member has at least one concave side.

2. The apparatus for raising the roof of a tent as claimed in claim 1, wherein said vertical support member has a horizontal member connected between said vertical support member and said means for raising the roof of said tent.

3. The apparatus for raising the roof of a tent as claimed in claim 1, wherein said means for raising the roof of said tent has a domed shape.

4. The apparatus for raising the roof of a tent as claimed in claim 2, wherein said horizontal member has aperture means for supporting additional equipment.

5. An apparatus for raising the roof of a tent in order to prevent water from accumulating on the roof, said tent having at least one vertical pole for supporting a tent roof, said apparatus comprising:

a vertical support member having means for attaching said vertical support member to said at least one vertical pole for supporting a tent roof, means attached to and extending from said vertical support member for raising the roof of said tent from a first position to a second position, said second position being above said first position, and wherein said means for attaching said vertical support member to said at least one vertical pole for supporting a tent roof is a forked member attached adjacent one end of said vertical support member, and a hooked member attached adjacent another end of said vertical support member.

6. The apparatus for raising the roof of a tent as claimed in claim 5, wherein said vertical support member has a horizontal member connected between said vertical support member and said means for raising the roof of said tent.

7. The apparatus for raising the roof of a tent as claimed in claim 5, wherein said means for raising the roof of said tent has a domed shape.

8. The apparatus for raising the roof of a tent as claimed in claim 6, wherein said horizontal member has aperture means for supporting additional equipment.

9. The apparatus for raising the roof of a tent as claimed in claim 5, wherein said vertical support member has at least one concave side.

* * * * *